United States Patent [19]

Desko

[11] 4,140,303

[45] Feb. 20, 1979

[54] DEVICE FOR USE IN RELINING REFRACTORY-LINED COVERS

[75] Inventor: Donald J. Desko, Pittsburgh, Pa.

[73] Assignee: United States Steel Corporation, Pittsburgh, Pa.

[21] Appl. No.: 881,348

[22] Filed: Feb. 27, 1978

[51] Int. Cl.[2] ..... F27D 1/16

[52] U.S. Cl. ..... 266/281

[58] Field of Search ..... 214/1 Q, 1 QA, 1 QE, 214/1 QF, 1 QG; 266/281, 287

[56] References Cited

U.S. PATENT DOCUMENTS

| | | | |
|---|---|---|---|
| 1,655,134 | 1/1928 | Clisson | 214/1 Q |
| 3,307,715 | 3/1967 | Gott et al. | 214/1 Q |
| 3,529,710 | 9/1970 | Fiegel | 214/1 Q |
| 3,680,716 | 8/1972 | Jenner | 214/1 Q |
| 3,970,205 | 7/1976 | Del Puppo | 214/1 Q |

*Primary Examiner*—Gerald A. Dost

*Attorney, Agent, or Firm*—Walter P. Wood

[57] ABSTRACT

A device for use in relining a refractory-lined cover of a large vessel, particularly a tundish used in continuous casting of metals. The device comprises a stationary table and a rectangular frame hingedly supported at one edge of the table to be turned between a first position alongside the table and a second position overlying the table. An upright cover is fixed temporarily to the frame in the first position. The frame and cover are turned to the second position and the old refractory chipped out. Next they are returned to the first position to dump the old refractory. They are turned back to the second position to install new refractory.

2 Claims, 4 Drawing Figures

DEVICE FOR USE IN RELINING REFRACTORY-LINED COVERS

This invention relates to an improved device for use in relining a refractory lined cover of a large vessel, particularly a tundish used in continuous casting of metals.

In the continuous casting art, a tundish is an intermediate refractory-lined vessel which receives liquid metal from a ladle and from which the metal is teemed into an open-ended mold. Conventionally a tundish has a removable cover which likewise is lined, usually with a castable refractory. Periodically the refractory lining must be cleaned out and replaced. A tundish cover is a large heavy item which is awkward to handle. In one example the cover measures 13'6" × 11'2" and weighs 11.5 tons. The usual practice in relining a tundish cover is to place the cover on a floor in inverted position with a crane, chip out the old refractory, flip the cover with the crane to dump the chipped pieces of old refractory, flip the cover back to its inverted position, and install the new lining. The practice is dangerous because of the uncontrolled maneuvering of the cover, and requires a large floor area.

An object of the present invention is to provide an improved device for holding, supporting and turning over a cover of a large vessel, particularly a tundish cover, to facilitate relining it.

A more specific object is to provide a device which includes a hinged frame, and means for temporarily fixing a cover to the frame, enabling the cover to be turned to inverted position for chipping old refractory, turned over for dumping chipped pieces of old refractory, and returned to inverted position for installing new refractory.

Figure 4:
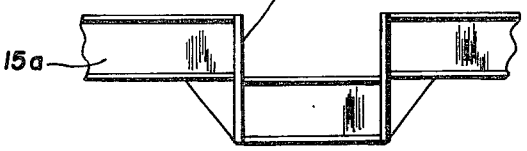
FIG. 4 is an elevational view from the left of FIG. 1 on line IV—IV.

The device comprises a flat stationary rectangular table 10 supported on a floor 12, preferably concrete. A structural member 13 is fixed to the floor alongside one edge of table 10 and carries a pair of upstanding posts 14 rigidly fixed thereto. A rectangular hinged frame, formed of rigidly connected side members 15 and **15*a* and end members 16 and 16*a*, preferably I-beams, is hinged to the posts. The hinge means includes slots 17 in the upper portions of the posts, pairs of brackets 18 fixed to the side member 15 and straddling the respective posts, and pins 19 extending through the brackets and slots. The structural member 13 carries rests 20 adapted to be contacted by the side member 15. The hinged frame has depending legs 21 at the side remote from brackets 18 adapted to contact the floor 12. The rests 20 and legs 21 cooperate to support the frame in a substantially level relation alongside the table, as shown in solid lines in FIG. 2. The side member 15*a* remote from the brackets carries a lug 22 adapted to be engaged by a chain shackle 23 suspended from a crane hook 24 for turning the frame about its hinged connection to the posts 14. Near each end the flanges of each side member 15 and 15*a* have cutouts 25. Filler plates 26 are welded to the members at each side of each cutout 25 (FIG. 3). The side member 15*a* also has a recess 28** (FIG. 4).

Figure 1:
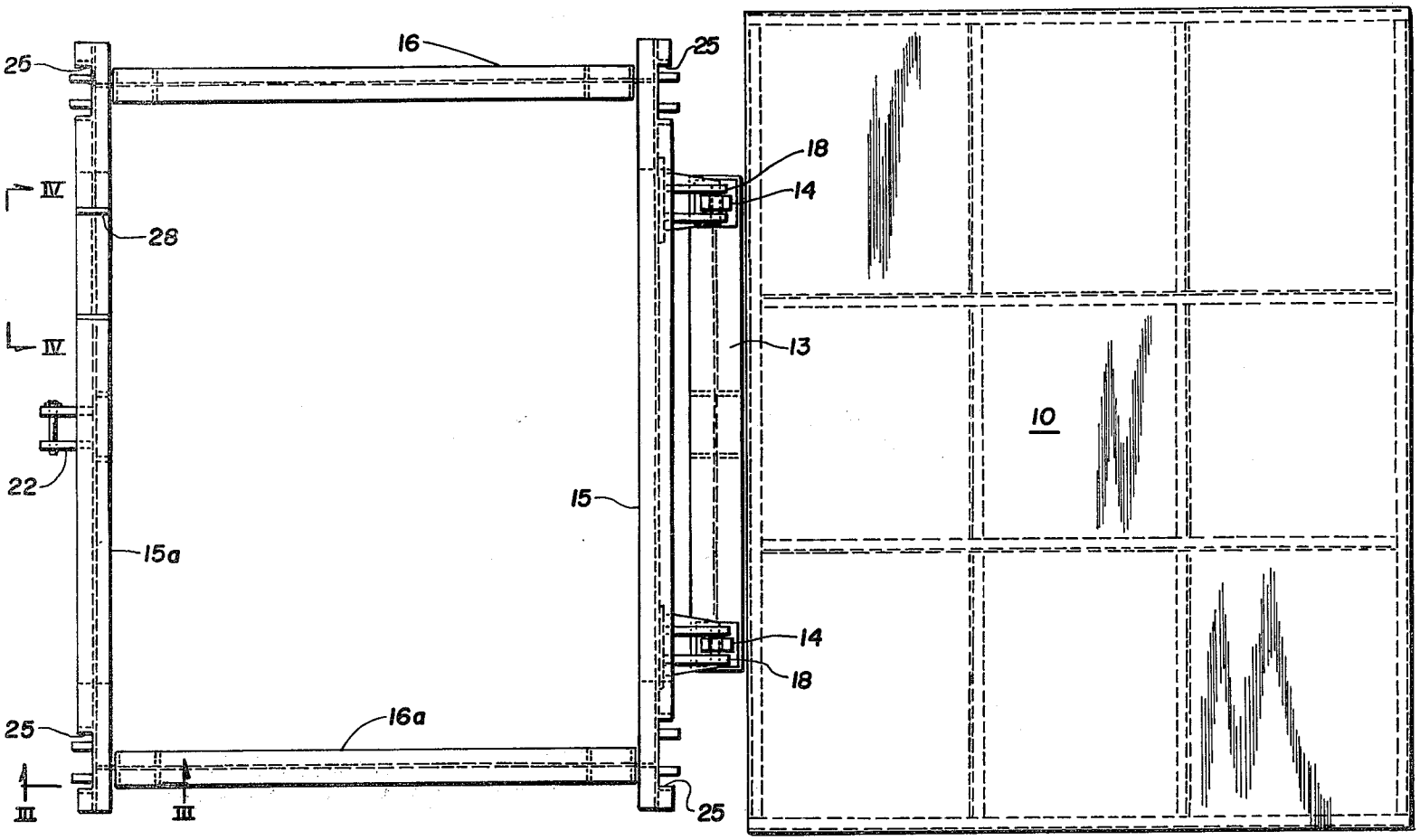
FIG. 1 is a top plan view of a relining device constructed in accordance with the invention.
Figure 2:
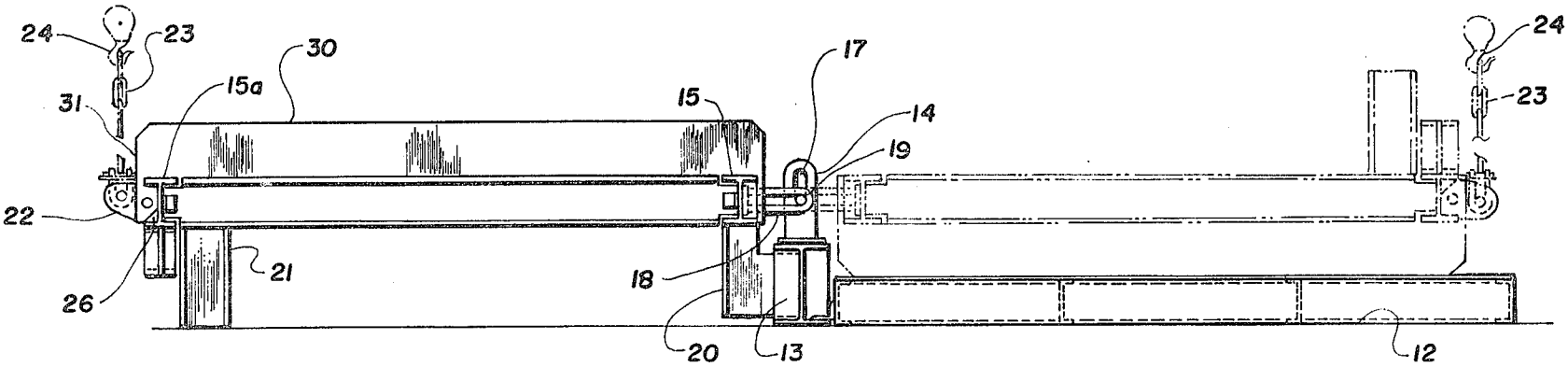
FIG. 2 is a side elevational view of the device with a tundish cover installed thereon.
Figure 3:
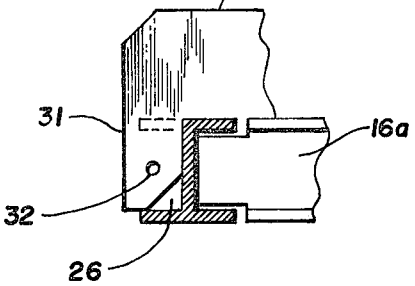
FIG. 3 is a vertical sectional view on a larger scale on line III—III of FIG. 1.

In operation, the hinged frame 15, 16 is turned to its first position alongside the table 10, as shown in solid lines in FIG. 2. A crane places an upright refractory lined cover 30 to be relined on the frame. The cover has alignment ears 31 which are received in cutouts 25. Pins 32 are inserted through matching holes in the filler plates 26 and ears 31 to fix the cover temporarily to the frame. Most tunish covers have a pour spout which can be accommodated in the recess 28.

Next the frame and cover are turned about the hinged connection to a second position overlying the table 10 to invert the cover, as shown in dot-dash lines in FIG. 2. The inverted cover lies flat against the upper surface of the table. The old refractory is chipped out. Next the frame and cover are returned to the first position and the chipped pieces of old refractory thereby dumped. The frame and cover are turned back to the second position and new refractory installed. Thereafter the frame and newly lined cover can be returned to the first position, from which a crane can pick up the cover and replace it on the vessel.

From the foregoing description it is seen that my invention affords a simple device which facilitates relining a refractory lined cover. The relining operation is controlled and hence safer. The operation is cleaner, since the old refractory is easily collected and disposed of. In a typical continuous-casting operation crane time is saved, since the overhead crane can set the cover on the device and leave the area, while a smaller semi-gantry crane can be used to turn the cover. The stationary table provides a true form surface for supporting the cover. The area required for the relining operation is reduced.

I claim:

1. A device for supporting a tundish cover while it is being relined, said device comprising:

a stationary table;

a structural member alongside said table;

a pair of upstanding posts fixed to said structural member and having slots near their upper ends;

a rectangular frame formed of rigidly connected side and end members;

pairs of brackets fixed to one of said side members and straddling said posts;

pins extending through said brackets and posts providing a hinged connection of said frame to said posts and enabling said frame to turn between a first position alongside said table and a second position overlying said table;

rests carried by said structural member and legs fixed to the side member at the side opposite said brackets, said rests and brackets cooperating to support said frame in a substantially level relation in said first position for receiving a tundish cover;

said side members having cutouts for receiving alignment ears of the tundish cover;

filler plates at the sides of said cutouts having holes for receiving pins temporarily affixing the tundish cover to said frame; and means on said frame for engagement by a crane hook for turning said frame between said positions;

said frame being placed in said first position while a tundish cover is affixed thereto, turned to said second position to invert the cover while old refractory is chipped out, returned to said first position to dump chipped pieces of old refractory, and turned back to said second position to install new refractory.

2. A device as defined in claim 1 in which the side member opposite said brackets has a recess for accommodating a pour spout on the tundish cover.

* * * * *